United States Patent [19]

Rose et al.

[11] 4,300,846

[45] Nov. 17, 1981

[54] HIGH SPEED PRINT HEAD SYSTEM AND METHOD

[75] Inventors: Stanley E. Rose; Robert G. Fulks, both of Phoenix, Ariz.

[73] Assignee: Genrad, Inc., Concord, Mass.

[21] Appl. No.: 108,237

[22] Filed: Dec. 28, 1979

[51] Int. Cl.[3] ..... B41J 3/12

[52] U.S. Cl. ..... 400/124; 101/93.05

[58] Field of Search ..... 101/93.05; 400/121, 400/124

[56] References Cited

U.S. PATENT DOCUMENTS

| | | | |
|---|---|---|---|
| 4,059,182 | 11/1977 | Gustafsson et al. | 400/124 |
| 4,076,111 | 2/1978 | Robinson et al. | 400/124 |
| 4,149,807 | 4/1979 | Avison et al. | 400/17 X |
| 4,150,902 | 4/1979 | Brescia | 400/17 |

FOREIGN PATENT DOCUMENTS

| | | | |
|---|---|---|---|
| 667421 | 6/1979 | U.S.S.R. | 400/124 |

*Primary Examiner*—Paul T. Sewell

*Attorney, Agent, or Firm*—Cahill, Sutton & Thomas

[57] ABSTRACT

A high speed print head system includes a print head pivotally and resiliently coupled to a frame which is laterally movable on a carriage system. The print head includes an elongated nose piece having therein a plurality of print rods which can be controllably forced beyond the end of the nose piece to impact a ribbon and paper supported by a platen to produce dots on the paper. The pivotal and resilient coupling is achieved by means of a flexure having first and second opposed connection points connected to the frame and third and fourth opposed connection points connected to the print head. Two permanent magnets are rigidly attached to the frame substantially above the axis of the elongated nose piece and substantially symmetrically with respect to the elongated nose piece. A pair of electromagnets rigidly attached to the print head opposite the respective permanent magnets are controllably energized to produce continuously variable forces between the frame and the print head. The continuously variable forces produce continuously variable pivoting of the print head about its neutral position, whereby high resolution character printing can be effected with a minimum dot overlap, and consequently with a minimum number of dot printing operations.

19 Claims, 8 Drawing Figures

HIGH SPEED PRINT HEAD SYSTEM AND METHOD

BACKGROUND OF THE INVENTION

1. Field of the Invention

The invention relates to high speed print head systems and methods, and more particularly to print head systems which form high resolution characters from a plurality of individually printed dots with minimum overlap.

2. Description of the Prior Art

Various high speed print head systems have been utilized to provide "printouts" from computer systems or computer controlled systems. A common type of high speed printer, referred to as a dot matrix printer, includes a column of axially movable print rods or wires which are axially movable to provide an impact dot printing function in a so-called dot matrix. All of the commonly known alphanumeric characters and various other symbols can be formed by a system utilizing a 5×7, 7×9 or other dot matrix configurations. The resolution of standard dot matrix characters printed by means of known dot matrix printers is reltively low. However, it is frequently desirable to print higher resolution characters with dot matrix printers.

One type of dot matrix printing system utilizes 7 or 9 spaced, vertically aligned axially movable print rods which are moved by means of electromagnetic clapper assemblies which controllably strike one end of each of the print rods, causing their opposite ends to impact ribbon and paper supported by a platen. The print head is rigidly supported on a carriage which continuously moves across the paper. By printing both from left to right and right to left, high printing speeds are achieved, although the resolution of resulting printed characters achieved is low. If increased resolution of the printed characters is required, multiple passes of the print head are required for each line of print, wherein for each pass the print head carriage position is offset by predetermined amounts in the X direction and the paper position is incremented by predetermined amounts in the Y direction. However, incrementing of the print head carriage position and incrementing of the vertical paper position are ordinarily achieved by means of stepper motors. Consequently, the smallest increments by which the print head and paper position can be varied have fixed values. Consequently, the amount of dot overlap in both the X and Y directions can not be precisely controlled. In order to obtain a desired level of resolution of characters, a larger amount of dot overlap between adjacently printed dots is required than would be required if the amount of the dot overlap could be precisely controlled. The greater the amount of unnecessary dot overlapping that occurs, the greater the number of individual dot printing operations will be required to print characters having a predetermined level of resolution; therefore, the greater the number of passes of the print head per line of print will be required.

Accordingly, it is an object of the invention to provide a high speed print head system and method which is capable of increasing the speed at which high resolution dot matrix characters can be printed.

Another object of the invention is to provide a print head system and method which reduces the number of passes which a dot matrix print head must make over a particular paper area to print a high resolution character.

Yet another object of the invention is to provide a print head system and method which minimizes the amount of dot overlap resulting from repeated dot printing operations in a particular area to obtain a character having a predetermined resolution level.

An important factor tending to reduce the printing speed of many known dot matrix printers is the fact that the inertia of the print head carriage and the paper advancing mechanism must be overcome for each incremental movement of the print head and paper advancing mechanisms. In addition to reducing printing speed, the overcoming of such inertia requires that high rates of acceleration and deceleration of mechanical parts occur, necessitating the use of expensive high precision, power consuming components.

Accordingly, it is another object of the invention to provide a low cost, high speed print head system and method which eliminates the necessity of stopping of the print head carriage while a particular dot is being printed.

It is a further object of the invention to provide a print head system and method wherein printed dot location is continuously variable in both the vertical and horizontal directions on the paper whereon the dots are to be printed.

A novelty search directed to the present invention uncovered the following U.S. Pat. Nos.: 3,726,379, 3,742,846, 3,884,148, 4,031,992, 4,082,035, and 4,101,017. None of the above patents disclose a print head system for generating a dot matrix wherein the print head position is continuously controllable in both the X and Y directions during high speed printing operations.

It is a yet further object of the invention to provide a high speed print head system and method which produces high resolution character printing by means of dot matrix print rods at high speed and lower cost than print head systems of the known prior art.

A still further object of the invention is to provide a high speed print head system and method which reduces stress and wear on moving mechanical components thereof.

Another object of the invention is to provide a print head system and method capable of greater accuracy in positioning of printed dots than has been previously achieveable with high speed dot matrix printers of the prior art.

Still another object of the invention is to provide a print head system which avoids the need to accurately control vertical movement of paper to achieve increased resolution by making multiple passes of a print head.

SUMMARY OF THE INVENTION

Briefly described, and in accordance with one embodiment thereof, the invention provides a print head system and method for continuous or linear variation of print head position during printing operations.

The print head system inclues an elongated nose piece positioned adjacent a piece of paper supported by a platen. A carbon ribbon may be positioned between the end of the elongated nose piece and the paper, but may be eliminated if pressure sensitive paper is utilized. A plurality of print rods, needles or print wires are disposed in the elongated nose piece. The print rods are supported in the elongated nose piece such that they are axially movable to strike the ribbon and/or paper to produce dots thereon. In the described embodiment of the invention, a plurality of electromagnetic clapper devices or other electrical-to-mechanical energy conversion devices are selectively actuatable to cause crossponding ones of the print rods to be "hammered" or axially thrust against the ribbon to produce a dot on the paper after the position of the print head has been established so that the dot will be properly positioned on the paper. The print head is pivotally and resiliently mounted on a frame, which is laterally slidable on precision carriage rods. The print head is continuously (rather than intermittently) moved along the carriage rod at a constant velocity as the clapper switches are selectively actuated by a control system to print dots in preselected character configurations on the paper. The timing of the clapper actuating operations takes into account the velocity of the print head frame along the carriage rod. The pivotal and resilient coupling is achieved by means of an annular flexure having first and second connection points connecting the flexure to the frame and third and fourth connection points connecting the flexure to a base plate supporting the print head assembly.

In the described embodiment of the invention, the flexure is an annular stainless steel ring, the main body of which has a first thickness. The first and second connection points lie approximately on a first diameter line equidistant from the center point of the flexure, and are approximately centered in subflexure regions which are of reduced thickness. The third and fourth connection points lie on approximately a second diameter line perpendicular to the first diameter line and are also surrounded by subflexure regions of reduced thickness. The resulting flexure structure provides sufficient resiliency that predetermind forces applied to first and second force receiving points of the print head tilt the print head, producing movement of the ends of the print rods anywhere within a predetermined character area on the paper. The flexure structure is sufficiently rigid that significant axial movement of the print head with respect to the frame during the printing operation is avoided. The print head is mounted as near its center of gravity as possible to minimize forces in the plane of the flexure. Mechanical oscillation of the print head is also avoided by the flexure structure. The first and second force receiving points lie along a line located a predetermined distance from the longitudinal axis of the elongated nose piece, and are symmetrically positioned with respect to the axis of the elongated nose piece. In the described embodiment of the invention, first and second permanent magnets are attached to the frame immediately adjacent the first and second force receiving points. Electromagnets are attached to the print head at the first and second force receiving points, so that energizing of the electromagnets produces attracting and/or repelling forces between the electromagnets and the respective permanent magnets. The magnitude of the forces applied at the first and second force receiving points is approximately proportional to the exitation currents directed through the first and second electromagnets.

In the described embodiment of the invention, a control system including a read only memory having a plurality of address inputs has data outputs connected to inputs of first and second digital-to-analog converters, respectively. The analog output signals of the first and second digital-to-analog converters are connected to driver circuits which produce the exitation currents for the first and second electromagnets. A first group of address inputs of the read only memory receive digital information representing a particular character to be printed. A second group of address inputs of the read only memory are connected to outputs of a counter which counts through a predetermined number of states for each character selected. Each location of the read only memory stores information. The stored information determines which clapper elements are to be actuated for the presently selected character for a plurality of different orientations of the print head with respect to the print head frame. The position of the end of the print head is controlled by the drive signals applied to the first and second electromagnets.

DESCRIPTION OF THE INVENTION

Figure 1:
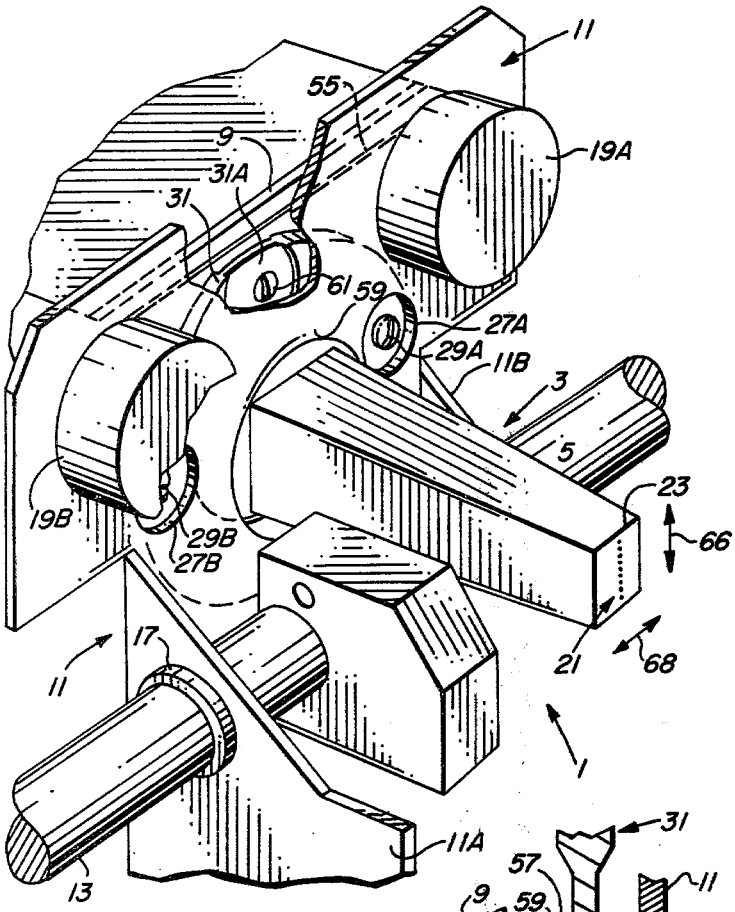
FIG. 1 is a partial perspective view illustrating the print head system of the present invention.

Referring now to the drawings, and particularly to FIG. 1, high speed print head system 1 includes a print head assembly 3 pivotally and resiliently coupled to a frame 11. Frame 11 is laterally movable along a precision carriage rod 13. Frame 11 includes a pair of perpendicular flanges or wings 11A and 11B which support a pair of precision slide bearings 17 rigidly mounted thereon.

Print head assembly 3 includes an elongated, tapered nose piece 5 having a print end 23 and a base end 25 which is attached to a base plate 9. Vertically aligned holes 21 are disposed in print end 23, as more clearly shown in FIG. 2. More specifically, circular holes 21A, 21B, etc. are vertically aligned in print end 23 of nose piece 5.

Figure 2:
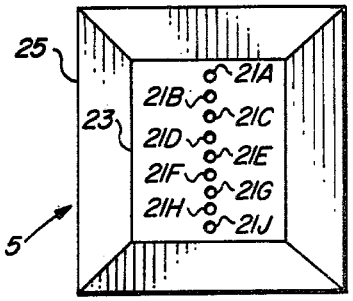
FIG. 2 is an end view of elongated nose piece 3 of the print head system of FIG. 1.
Figure 5:
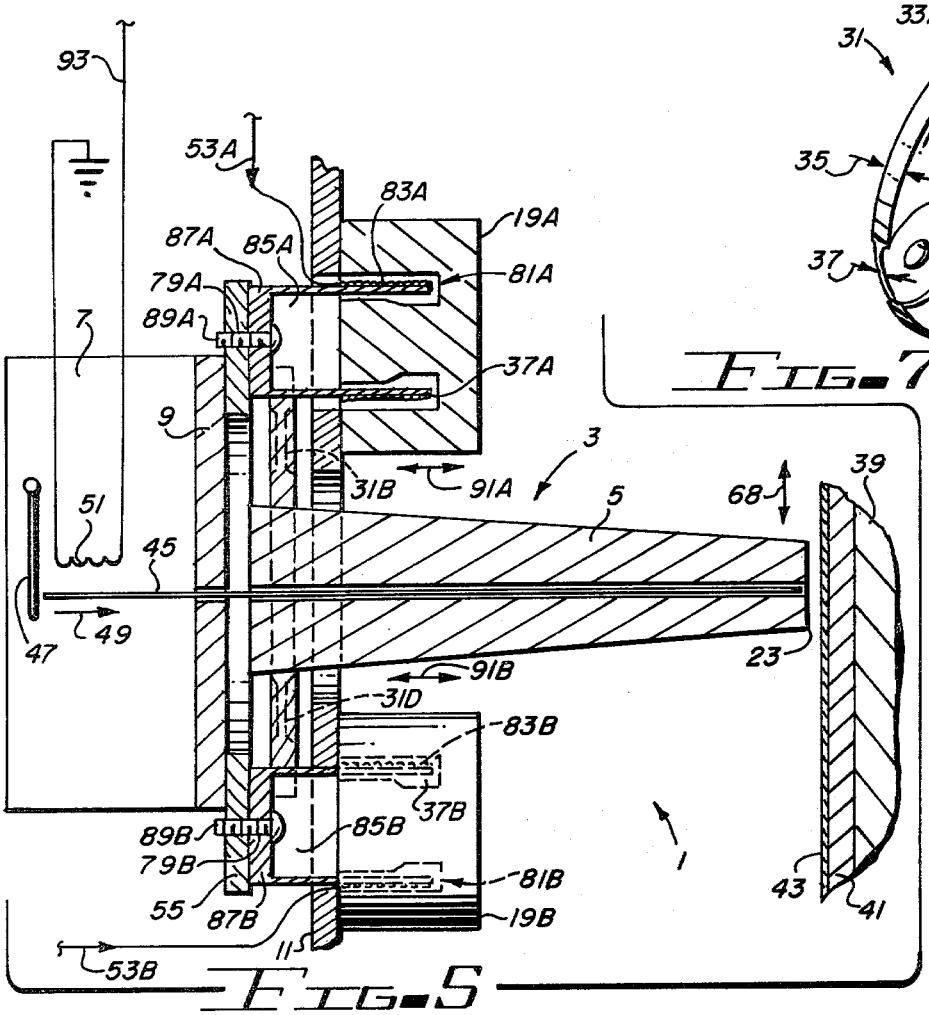
FIG. 5 is a partial schematic top view diagram illustrating the print head system of FIG. 1.

As can be seen from FIGS. 1, 2 and 5, nine vertically aligned print rods, wires or needles 45 are disposed within print head 3 so that they can be selectively struck by nine corresponding clapper arms 47, causing the ends of the print rods to be thrust out of the holes 21A, 21B, etc., and strike ribbon 43, producing a dot on paper 41, which is supported by rigid platen 39.

Each of the clapper arms 47 can be suddenly and forcefully pivoted in the direction indicated by arrow 49 (FIG. 5) by driving of a predetermined drive current through control conductor 93 and electromagnet 51, as is well known to those skilled in the art.

Referring now to both FIGS. 1 and 5, print head assembly 3 includes a body section 7 wherein the nine clapper arms 47 and corresponding electromagnets 51 are housed. Body 7 is supported by base plate 9, which, as previously mentioned, is also rigidly attached to nose piece 5.

Figure 7:
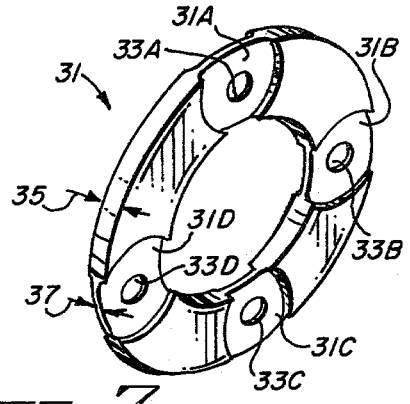
FIG. 7 is a perspective view of the flexure 31 of the print head system of FIG. 1.

The above mentioned pivotal and resilient coupling of print head assembly 3 to laterally movable frame 11 is accomplished by means of a flexure plate 31, hereinafter referred to simply as a flexure. Flexure 31 is illustrated in detail in FIG. 7, wherein it can be seen that flexure 31 is an annular disc. Flexure 31 has four subflexure regions 31A, 31B, 31C and 31D, each having thickness reduced from that of the remaining portions of flexure 31. More specifically, the thickness of subflexures 31A–31D, indicated by arrows 37 in FIG. 7, is approximately 32 mils, and is approximately one-half the thickness of the remaining portions of flexure 31, indicated by arrows 35 in FIG. 7.

Frame 11 is connected to flexure 31 by means of holes 33A and 33C, which are aligned along a vertical diameter of flexure 31. Print head system 3 is attached to flexure 31 by means of holes 33B and 33D, which are approximately aligned along a diameter which is approximately perpendicular to the first mentioned diameter.

Figure 4:
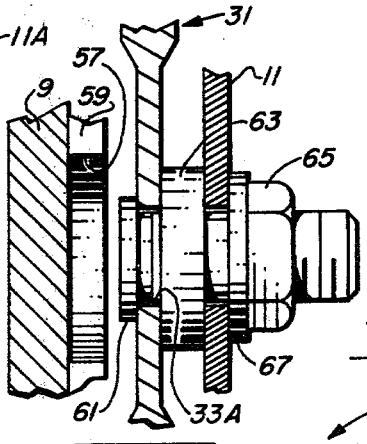
FIG. 4 is a partial sectional detail drawing illustrating connection of frame 11 to flexure 31.

More specifically, frame 11 is attached to flexure 31 in the manner indicated by the detail sectional view of FIG. 4 at each of holes 33A and 33C. Bolt 61 extends through hole 33A of subflexure 31A and also through a spacer 63 disposed between subflexure 31A and frame 11. Bolt 61 extends through a hole in frame 11, the threaded end being securely attached by means of nut 65. A clearance hole 57 in support plate 55 prevents the head of bolt 61 from engaging support plate 55 during pivoting of print head assembly 3, as subsequently described. Support plate 55 is rigidly attached to base plate 9. Frame 11 is similarly attached to subflexure 31C.

Figure 3:
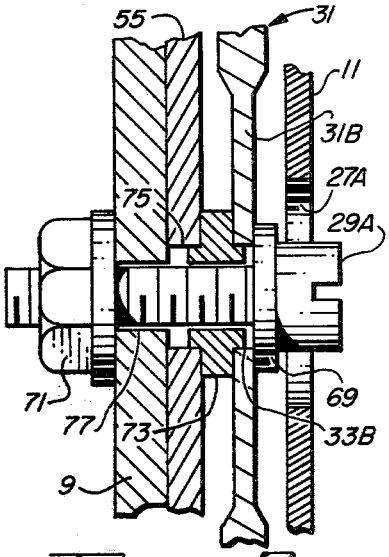
FIG. 3 is a partial sectional detailed drawig illustrating connecting of support plate 55 to flexure 31.

Print head system 3 is attached to subflexures 31B and 31D in the manner indicated by the partial sectional detailed drawing of FIG. 3. More specifically, bolt 29A extends through clearance hole 27A in frame 11, and passes through holes 33B of subflexure 31B. Flexure 31 is separated from support plate 55 by means of spacer 73. Bolt 29A extends through hole 75 in support plate 55, hole 77 in base plate 9, and is rigidly secured by nut 71.

Figure 6:
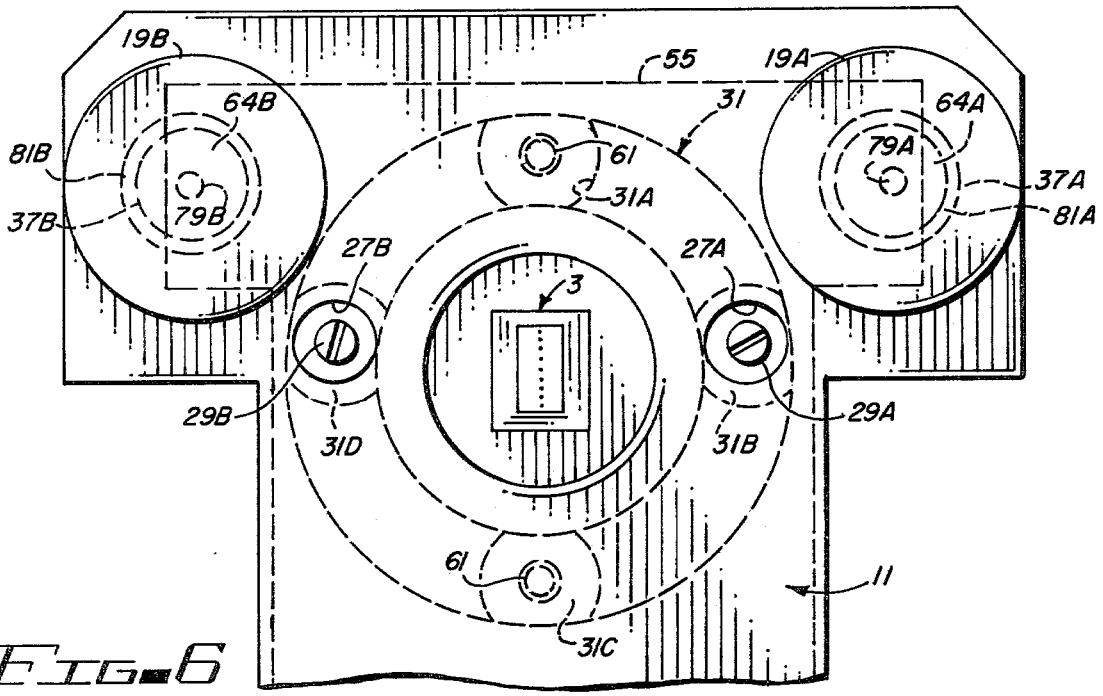
FIG. 6 is a partial end view diagram illustrating the print head system of FIG. 1.

Referring now to FIG. 6, it is seen that support plate 55 has a pair of ears 64A and 64B having electromagnet mounting holes 79A and 79B drilled therein, respectively. Referring now to both FIGS. 5 and 6, electromagnets 81A and 81B are attached, respectively, to ears 64A and 64B of support plate 55 by means of threaded bolts 89A and 89B, respectively. The two electromagnets are identical; only electromagnet 81A will be described in detail.

electromagnet 81A includes a hollow cylindrical insulating body 85A having a support plug 87A at the bottom thereof. Bolt 89A extends through a hole in support plug 87A and is screwed into threads in hold 79A. A plurality of electrical windings 83A are wound about the upper portion of body 85A. A pair of conductors designated by line 53A are connected to the respective ends of the windings 83A. Similarly, electromagnet 81B has the ends of its winding connected to a pair of conductors 53B.

Referring now to FIG. 5, first and second permanent magnets 19A and 19B are rigidly attached to frame 11. Permanent magnets 19A and 19B have annular cavities 37A and 37B, respectively, disposed therein. The clearance of the annular cavities 37A and 37B is sufficiently large to permit electromagnets 83A and 83B to freely move in and out of the respective cavities in the direction indicated by arrows 91A and 91B, respectively.

Thus, when the windings 83A and 83B are excited by suitable DC drive currents applied to winding leads 53A and 53B, respectively, forces are produced which are between electromagnet 81A and permanent magnet 19A, and electromagnet 81B and permanent magnet 19B, respectively. The direction of the forces is reversed by reversing the directions of the currents forced through the windings 83A and 83B, respectively.

Referring now to FIG. 6, it is seen that the pushing or pulling forces produced on support plate 55 (and hence or print head assembly 3) by electromagnets 81A and 81B are effectively applied at the locations of holes 79A and 79B of support plate 55. Holes 79A and 79B in support plate 55 lie along a line located substantially above a line passing through the axes of bolts 29A and 29B. Thus, if equal drive currents are applied to winding terminals 53A and 53B, equal forces will be produced between elctromagnets 81A and 81B and the corresponding permanent magnets 19A and 19B. Such forces will tend to cause print head system 3 to rock about a line passing through the axes of bolts 29A and 29B, causing the print end 23 of nose piece 5 to move vertically in the directions indicated by arrow 66 in FIG. 1, depending upon the directions of the above mentioned drive currents.

It can be seen that the forces applied to support plate 55 by electromagnets 81A and 81B when they are energized are symmetrically located to the right and left sides of a line passing through the centers of bolts 61 in FIG. 6. Consequently, the print end 23 of nose piece 5 can be made to move laterally in the directions indicated by arrow 68 in FIG. 1 by applying drive currents of the appropriate magnitudes and polarities to winding terminals 53A and 53B to produce different or opposed forces between electromagnets 81A and 81B and corresponding permanent magnets 19A and 19B, respectively.

It is therefore apparent that by properly selecting the magnitude and polarity of the drive currents applied to winding terminals 53A and 53B, any desired combination of lateral and vertical movement components of print end 23 can be produced within the range of forces capable of being produced between the respective electromagnets and permanent magnets described above.

The permanent magnets 19A and 19B for a prototype model of print head system 1 were obtained by disassembling a Realistic Model 40-1210B speaker manufactured by Radio Shack, Inc. The three quarter inch voice coils from the same speaker were utilized to implement electromagnets 81A and 81B. Using drive currents in the range from 0 to approximately one ampere, forces between the respective permanent magnets and electromagnets in the range from 0 to 0.5 lbs. can be obtained. For the above described embodiment of the invention, this force was sufficient to produce lateral excursions of approximately 10 mils at print end 23 of nose piece 5, which excursions are adequate to enable print head system 1 to "paint" an entire dot matrix character area. With zero force applied to electromagnets 81A and 81B, the center print rod 21D (FIG. 2) is aligned in the center of a dot matrix character area. By controlling the winding drive currents of the electromagnets, a dot can be placed anywhere within a 30 mil by 30 mil area of paper 41 by the center point rod 21D.

In the described embodiment of the invention, the print rod diameter is approximately 15 mils. The length of nose piece 5 is approximately 2.2 inches. The inside diameter of flexure 31 is approximately 1.3 inches, and the outside diameter is approximately 2.2 inches. The diameters of the subflexure regions 31A–31D are approximately 0.75 inches. The thickness of the subflexure regions 31A–31D is approximately 32 mils, and the thickness of the remaining portions of flexure 31 is approximately 62 mils. Flexure 31 is machined from stainless steel.

The entire print head assembly including nose piece 5, print rods 45, body 7 and the clapper arm and clapper magnet assembly is comparably available as a unit from Lear Siegler, Inc., and is referred to by them as their "Ballistic Matrix Print Head."

The distance between the center of bolts 29A and 29B in FIG. 6 and the line between the centers of holes 79A and 79B is approximately 0.75 inches. The distance between the center of hole 79A and the line passing through the centers of bolts 61 (FIG. 6) is approximately 1.25 inches.

Figure 8:
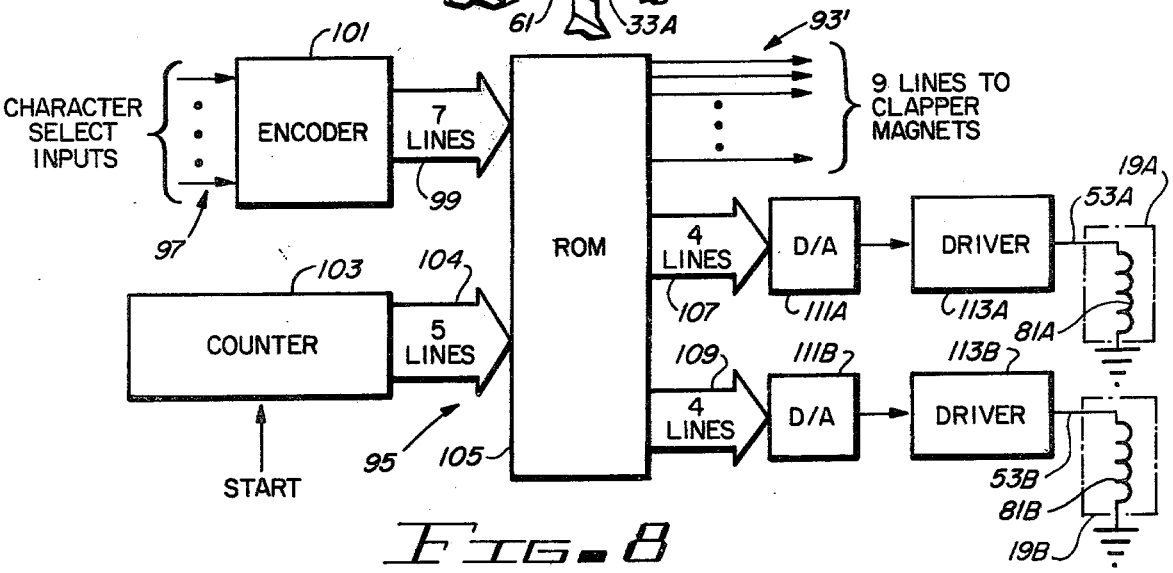
FIG. 8 is a block diagram of a control system which can be utilized to produce the drive signals necessary to operate the print head system of the invention.

A simple control system for generating the nine control signals required to energize the nine clapper magnets 51 (FIG. 5) and to generate the drive currents applied to winding leads 53A and 53B in FIG. 5 is shown in FIG. 8. The control system of FIG. 8 includes a read only memory having a plurality of address inputs, seven of which are connected to conductors of encoder output bus 99 and five of which are connected to the respective conductors of counter output bus 103. Read only memory 105 includes nine data outputs 93' coupled by means of conventional driver circuits (not shown) to the respective terminals 93 of the nine clapper magnets 51 (FIG. 5). Read only memory 105 also includes four data outputs 107 connected to four inputs of digital-to-analog converter 111A and four more data outputs 109 connected to four inputs of digital-to-analog converter 111B. The output of driver amplifier 113A is connected to one of the winding leads 53A of electromagnet 81B.

The seven most significant address inputs of read only memory 105 are connected to the seven lines of bus 99, which are respectively connected to the outputs of encoder 101. Encoder 101 has 27 character select inputs 97 which correspond to various characters to be printed. The next five most significant address inputs of read only memory 105 are connected to the respective conductors of bus 103, which are connected to five outputs of counter 103.

The control system of FIG. 8 operates as follows. One of the character select inputs 97 is energized to indicate that a particular character is to be printed. Encoder 101 generates a character select address on the seven lines of bus 99. (Alternatively, the character select address can be generated by any other suitable digital circuitry which may be convenient.) Next, counter 103, starting from its all "zeros" state, counts to thirty-two, while the seven most significant address inputs to read only memory 105 remain unchanged. This causes thirty-two different addresses of read only memory 105 to be accessed. Each of the thirty-two addresses contains information corresponding to the precise dot locations of the selected character. Thus, each of the nine clapper magnets can be fired as many as thirty-two times during the printing of a single character. Similarly, the X and Y position coorrdinators or print end 23 of nose piece 5 can be altered as many as thirty-two times during the printing of the selected characters.

It should be remembered that the entire print head assembly 1 moves laterally along carriage rod 13 at a constant velocity. Thus, it is possible, by storing appropriate control information in read only memory 105, to cause the nine print rods to print enough dots, with a minimum amount of dot overlap, to completely blacken the entire 30 mil by 30 mil area alotted to each print rod.

The individual blocks shown in FIG. 8 can all be readily implemented by a wide variety of commercially available integrated circuit parts. All of the major semiconductor manufacturers, such as Texas Instruments, can provide a wide variety of suitable standard encoders, counters, read only memories, and driver amplifiers. One skilled in the art can readily select suitable devices from the wide variety which are commercially available and connect them in the manner indicated by the specification sheets provided by the manufacturer. Digital-to-analog converters 111A and 111B are readily available from any of the major semiconductor manufacturers and are also available from several companies, including Burr-Brown Research Corporation and Analog Devices, which specialize in hybrid digital-to-analog conversion devices. The driver amplifiers 113A and 113B can be readily selected from a wide variety of commercially available current drivers by those skilled in the art.

One skilled in the art can readily interpose suitable timing circuitry to delay the firing of the clapper switches until print end 23 of nose piece 5 has moved to its proper position in response to the information on buses 107 and 109 for each of the thirty-two states of counter 103.

One skilled in the art can readily provide the stored information required in read only memory 105 to accomplish the above described information. One way of obtaining this information would be to manually vary the digital inputs to digital-to-analog converters 111A and 111B to obtain the empirical relationships between digital inputs to digital-to-analog converters 111A and 111B and the corresponding positions of the ends of the print rods. This information could readily be used by a skilled read only memory programmer to create a stored table containing the dot locations (adjusted for velocity of frame 11 with respect to carriage rod 13) for all character printable for the system.

While the invention has been described with reference to a particular embodiment thereof, numerous variations of the described embodiment may be made within the spirit and scope of the invention as set forth in the appended claims. For example, other pivoting means than the described flexure could be utilized. Similarly, other force producing means between frame 11 and print head assembly 3 could be provided to accomplish the same or equivalent result. Other circuitry than that shown can be used to control the print head assembly. For example, a conventional microprocessor system could be readily utilized by those skilled in the art to perform the functions of the circuitry shown in FIG. 8.

What is claimed is:

1. A printing apparatus comprising in combination:

a. a paper support means for supporting a piece of paper;

b. mark producing means movable against said paper or a mark producing ribbon for producing a mark on said paper, said mark producing means having a portion adjacent to said paper;

c. first means for moving said mark producing means against the paper or ribbon to produce a mark covering a first area of said paper;

d. a frame element;

e. resilient means for pivotally supporting and coupling said mark producing means to said frame element to allow said portion of said mark producing means to move with 2 degrees of freedom in any direction that is substantially parallel to said first area of said paper, said resilient means including a flexible plate member having first, second and third spaced points, said first point of said flexible plate member being attached to said frame element, said second and third points of said flexible plate member being connected to said mark producing means;

f. first and second force producing means for producing first and second forces between said frame element and said resilient means, said first and second forces being applied at said first and second points of said, flexible plate member, said first and second forces and said resilient means cooperating to urge said mark producing means to move in a predetermined direction with respect to the paper, the distance and direction through which said mark producing means moves with respect to said paper being substantially continuously variable.

2. The printing apparatus of claim 1 wherein said first means moves said mark producing means in response to a first control signal.

3. The printing apparatus of claim 2 wherein said first and second force producing means produce said first and second forces in response to second and third control signals, respectively.

4. The printing apparatus of claim 3 wherein said mark is a dot.

5. The printing apparatus of claim 1 wherein said flexible plate has a fourth point, said fourth part being attached to said element.

6. The printing apparatus of claim 5 wherein said flexible plate is an annular disc-shaped plate, and wherein said first and third points lie on a line perpendicular to a line passing through said second and fourth points.

7. The printing apparatus of claim 6 wherein said annular disc-shaped plate includes four regions, said first, second, third and fourth points each being approximately centrally located in a respective one of said four regions, said four regions being substantially thinner than other portions of said annular disc-shaped plate, the thickness and extent of said four regions being such that most of the flexing of said annular disc-shaped plate occurs in said four regions in response to said first and second forces, the thickness of said other portions being such that axial displacement of aid support means during said flexing is negligible.

8. The printing apparatus of claim 7 wherein said support means includes an elongated nose piece, said frame including a frame plate which is substantially parallel to said annular disc-shaped plate, said support means including a support plate which is substantially parallel to said annular disc-shaped plate, said annular disc-shaped plate being disposed between said frame plate and said support plate, said frame plate having a hole aligned with the hole in said annular disc-shaped plate, said elongated nose piece extending from said support plate through the holes in said annular disc-shaped plate and said frame plate.

9. The printing apparatus of claim 1 wherein said first and second force producing means each include a first magnet attached to said frame element and a second magnet attached to said support means wherein one of said first and second magnets in an electromagnet.

10. The printing apparatus of claim 9 wherein said first and second magnets of said first force producing means cooperate to produce said first force and said first and second magnets of said second force producing means cooperate to produce said second force, said first and second forces being responsive to first and second control currents produced in the windings of said respective electromagnets in response to said second and third control signals, respectively.

11. The printing apparatus of claim 9 wherein said second magnets of said first and second force producing means are electromagnets, thereby reducing the amount of mass attached to said supporting means.

12. The printing apparatus of claim 3 further including control means for producing said first, second, and third control signals, said control means including memory means for storing mark location information for a plurality of characters which said printing apparatus is capable of printing, a portion of said mark location information corresponding to a particular character including mark locations for each mark included in that character.

13. The printing apparatus of claim 12 wherein said control means includes character selecting means for addressing said memory means to fetch said mark information corresponding to a selected mark.

14. The printing apparatus of claim 13 wherein said control means includes counting means for repetitively counting from a first logic word to a second logic word during selection of each respective character, wherein said character selecting means includes a plurality of digital outputs coupled to a first group of address inputs of said memory means, said counting means having a plurality of digital outputs connected to a second group of address inputs of said memory means, said address inputs of said second group being less significant address inputs than the address inputs of said first group.

15. The printing apparatus of claim 12 wherein said control means includes digital to analog conversion means for producing first and second analog signals representing said first and second forces, respectively.

16. The printing apparatus of claim 6 wherein said first and second points of said mark producing means lie along a line which is located a predetermined distance from a line passing through two of said points of said annular disc-shaped plate, said two points being either said first and third points of said annular disc-shaped plate or said second and fourth points of said annular disc-shaped plate.

17. The printing apparatus of claim 16 wherein said first and second points of said mark producing means are equally distant from a line passing through the center of said annular disc-shaped plate.

18. A printing apparatus comprising in combination:

a. a paper support means for supporting a piece of paper;

b. mark producing means movable against said paper or a mark producing ribbon for producing a mark on said paper, said mark producing means having a portion adjacent to said paper;

c. first means for moving said mark producing means against said paper or ribbon to produce a mark covering a first area of said paper;

d. a frame element;

e. resilient means for pivotally, frictionlessly supporting and coupling said mark producing means to said frame element to allow said portion of said mark producing means to move with two degrees of freedom in any direction that is substantially parallel to said first area, said resilient means having first and second spaced points; and f. first and second force producing means for producing first and second forces between said frame element and said resilient means, said first and second forces being applied at said first and second spaced points to flex said resilient means to cause said portion of said mark producing means to move substantially parallel to said area of said paper in a predetermined direction.

19. A method of operating a dot printing head to print a selected character on a piece of paper with a predetermined level of resolution with minimum dot overlap, said method comprising the steps of:

a. activating the dot printing head to print a first dot on the piece of paper, the dot printing head having a portion adjacent to the piece of paper, the dot printing head being frictionlessly, pivotally supported by and coupled to a movable frame by means of a resilient, flexible member;

b. simultaneously applying first and second forces to first and second spaced points, respectively, on said resilient, flexible member to flex said resilient, flexible member to pivot the dot printing head and cause the portion of the dot printing head adjacent to the piece of paper to move with two degrees of freedom in any direction that is substantially parallel to the piece of paper; and, c. actuating the print head to print a second dot on the piece of paper a predetermined distance in said direction from said first dot.

* * * * *